US008905583B2

(12) United States Patent
Dubord

(10) Patent No.: US 8,905,583 B2
(45) Date of Patent: Dec. 9, 2014

(54) ADJUSTABLE LIGHT EMITTING DIODE LIGHTING ASSEMBLY, KIT AND SYSTEM AND METHOD OF ASSEMBLING AN ADJUSTABLE LIGHT EMITTING DIODE LIGHTING ASSEMBLY

(76) Inventor: Jack Guy Dubord, Escondido, CA (US)

( * ) Notice: Subject to any disclaimer, the term of this patent is extended or adjusted under 35 U.S.C. 154(b) by 155 days.

(21) Appl. No.: 13/151,158

(22) Filed: Jun. 1, 2011

(65) Prior Publication Data

US 2011/0228544 A1 Sep. 22, 2011

Related U.S. Application Data

(63) Continuation-in-part of application No. 12/261,754, filed on Oct. 30, 2008, now Pat. No. 8,104,920, and a continuation-in-part of application No. 12/386,545, filed on Apr. 20, 2009, now Pat. No. 8,061,868.

(60) Provisional application No. 61/057,858, filed on Jun. 1, 2008.

(51) Int. Cl.

| | |
|---|---|
| ***F21V 21/26*** | (2006.01) |
| ***F21S 2/00*** | (2006.01) |
| ***F21V 15/01*** | (2006.01) |
| ***F21V 19/00*** | (2006.01) |
| ***F21V 29/02*** | (2006.01) |
| *F21V 21/005* | (2006.01) |
| *F21Y 101/02* | (2006.01) |

(52) U.S. Cl.

CPC ..... *F21S 2/005* (2013.01); *F21V 15/011* (2013.01); *F21V 19/001* (2013.01); *F21V 29/027* (2013.01); *F21V 15/013* (2013.01); *F21V 21/005* (2013.01); *F21Y 2101/02* (2013.01)

USPC ..... 362/269; 362/282; 362/283; 362/285; 362/287; 362/419; 362/421; 362/370; 362/364; 362/365; 362/366; 362/217.13; 29/592.1; 174/653

(58) Field of Classification Search

CPC ..... F21V 21/30; F21V 23/008

USPC ..... 362/217.13, 368, 373, 294, 269, 282, 362/283, 285, 287, 419, 421, 370, 362/364–366; 29/592.1; 174/653

See application file for complete search history.

(56) References Cited

U.S. PATENT DOCUMENTS

| | | | | |
|---|---|---|---|---|
| 1,488,175 | A * | 3/1924 | Strandell | 174/653 |
| 4,039,817 | A | 8/1977 | Williams | |
| 4,290,098 | A * | 9/1981 | Pierson | 362/485 |
| 4,582,449 | A * | 4/1986 | Vosswinkel | 404/25 |
| 5,183,330 | A | 2/1993 | Rishel et al. | |
| 5,404,297 | A * | 4/1995 | Birk et al. | 362/421 |

(Continued)

*Primary Examiner* — Jong-Suk (James) Lee
*Assistant Examiner* — Tsion Tumebo
(74) *Attorney, Agent, or Firm* — Jerry R. Potts

(57) ABSTRACT

Adjustable light emitting diode lighting assembly, kit and system and method of assembling an adjustable light emitting diode lighting assembly. The adjustable light emitting diode lighting assembly comprises a mounting can adapted to be mounted in a housing and an upper locking ring adapted to be mounted to the mounting can. A lower base ring is spaced-apart from the upper locking ring. An adjustable collar coupled to the upper locking ring and the lower base ring and interposed therebetween is provided for adjustably supporting a light emitting diode module over a plurality of light distribution angles. Conductive, radiative and/or convective heat sinks are provided for removing heat produced by the light emitting diode module to maintain luminous efficiency and service life of the light emitting diode module.

14 Claims, 13 Drawing Sheets

(56) References Cited

U.S. PATENT DOCUMENTS

| | | | | |
|---|---|---|---|---|
| 5,672,004 | A | 9/1997 | Schmidt, Jr. | |
| 6,371,628 | B1 * | 4/2002 | Ward | 362/287 |
| 6,375,338 | B1 * | 4/2002 | Cummings et al. | 362/276 |
| 6,578,994 | B1 * | 6/2003 | Beyerlein | 362/490 |
| 6,994,457 | B2 * | 2/2006 | Lee | 362/366 |
| 7,744,259 | B2 * | 6/2010 | Walczak et al. | 362/421 |
| 7,784,754 | B2 | 8/2010 | Nevers et al. | |
| 8,142,057 | B2 * | 3/2012 | Roos et al. | 362/364 |
| 2006/0158873 | A1 * | 7/2006 | Newbold et al. | 362/147 |
| 2006/0262544 | A1 * | 11/2006 | Piepgras et al. | 362/373 |
| 2009/0086474 | A1 * | 4/2009 | Chou | 362/230 |
| 2009/0213595 | A1 * | 8/2009 | Alexander et al. | 362/373 |

* cited by examiner

ADJUSTABLE LIGHT EMITTING DIODE LIGHTING ASSEMBLY, KIT AND SYSTEM AND METHOD OF ASSEMBLING AN ADJUSTABLE LIGHT EMITTING DIODE LIGHTING ASSEMBLY

CROSS-REFERENCE TO RELATED APPLICATIONS

This application is a non-provisional continuation-in-part utility patent application of non-provisional continuation-in-part utility patent application with Ser. No. 12/386,545 filed Apr. 20, 2009 and titled "ADJUSTABLE LED LIGHTING SYSTEM, KIT AND METHOD OF USING SAME," which in turn was from a non-provisional continuation-in-part utility patent application with Ser. No. 61/057,858 filed Jun. 1, 2008 and titled "LED ADJUSTABLE FOCUS LIGHTING SYSTEM", and a non-provisional continuation-in-part utility patent application of non-provisional continuation-in-part utility patent application with Ser. No. 12/261,754, filed on Oct. 30, 2008, and titled "ADJUSTABLE MODULLAR LIGHTING SYSTEM AND METHOD OF USING SAME", which is from a provisional patent application with Ser. No. 61/057,858 filed Jun. 1, 2008 and titled "LED ADJUSTABLE FOCUS LIGHTING SYSTEM."

TECHNICAL FIELD

This invention generally relates to light emitting diode lighting apparatus and methods and more particularly relates to an adjustable light emitting diode lighting assembly, kit and system and method of assembling an adjustable light emitting diode lighting assembly.

BACKGROUND ART

There have been many different types and kinds of light emitting diode (hereinafter referred to as "LED") light fixtures. For example, reference may be made to the following United States patents:

U.S. Pat. No. 7,614,769 B2 to Sell discloses an LED conversion system that is used in connection with a recessed light housing mounted in a ceiling. The housing has a can with apertures through it and an electrical socket mounted inside. An electrical source of AC current is connected to the socket. A lamp fitting into the can has a shell with a flat or domed top and a plurality of LEDs. A power supply converts AC to DC current to power the LEDs.

U.S. Pat. No. 7,670,021B2 to Chou discloses a lighting assembly that comprises a light fixture. The light fixture includes a trim formed by a stamping or die casting process. The trim has thermally conductive properties and includes a flange around a perimeter of the trim. The light fixture includes a light source mounted to a central portion of a front surface of the trim, and a heat sink formed by an extrusion or die casting process. The heat sink has thermally conductive properties and is mounted to a back surface of the trim. A recessed can housing mounted to a surface may be provided.

U.S. Pat. No. 7,618,150B2 to Chien discloses a multiple LED light device with adjustable angle function and that has multiple LED-units, each including a housing and extensions that fit within tracks to adjust the LED's light beam angle, thereby enabling a plurality of the LED-units to direct light beams to different desired locations.

While the above-mentioned features are satisfactory for some applications, it is clear that none of the above-mentioned U.S. patents appear to expressly disclose minimizing heat loss by conductive heat transfer. Neither do any of these patent documents appear to disclose (1) minimizing heat loss by active cooling of the LED lighting apparatus; (2) a light fixture which has an LED swivel feature for convenient directional control of the LED light; (3) active cooling of the light fixture; (4) the need for cooling the plurality of LED units; nor (5) the ability to easily customizing LED units in the field for accommodating existing recessed ceiling housing boxes of different sizes.

More particularly, none of these U.S. patents teach or disclose minimizing substantial heat loss by a plurality of interconnected heat conducting members. Nor do they suggest or teach minimizing heat loss by combining a plurality of interconnecting heat conductive members with an active cooling system. In addition, none of these U.S. patents disclose or suggest coupling the interconnected heat conductive members in such a manner as to provide the LED light fixture with a swivel feature to provide convenient directional control of the spread of LED light over a multiple number of user selected light distribution angles. Still yet, none of these U.S. patents teach or disclose a cooling system and method that permits a plurality of the LED lighting fixtures to be cooled. Finally, and perhaps most importantly, none of these U.S. patents disclose an LED light fixture that can be quickly and easily customized in the field to retrofit existing lighting units with recessed ceiling housing boxes of different sizes, such as housing boxes of 3-inch to 8-inch diameters or more, for example.

In short then, the prior art approaches mentioned, hereinabove do not appear to provide an adjustable LED lighting assembly, kit and system and method of assembling an adjustable LED lighting assembly, as described and claimed hereinbelow.

Therefore, there is a need to provide an adjustable LED lighting assembly, kit, and system and method of assembling an adjustable LED lighting assembly, as described and claimed hereinbelow.

SUMMARY OF THE INVENTION

The present invention addresses the shortcomings of the prior art approaches mentioned hereinabove by providing an adjustable. LED lighting assembly, kit and system and method of assembling an adjustable LED lighting assembly. The adjustable LED lighting assembly, kit, system and method permits a user of the adjustable LED lighting assembly, kit, system and method to adjust a light distribution angle over a wide range of light distribution angles while simultaneously providing an efficient heat sink arrangement that assures enhanced luminous efficiency and operational life for the LED disposed within the adjustable LED lighting assembly, kit and system.

According to an aspect of the present invention, there is provided an adjustable light emitting diode lighting assembly, comprising: a mounting can adapted to be mounted in a housing; an upper locking ring adapted to be mounted in the mounting can; a lower base ring adapted to be spaced-apart from the upper locking ring; and a collar adapted to be coupled to the upper locking ring and the lower base ring and interposed therebetween for adjustably supporting a light emitting diode module over a plurality of light distribution angles, whereby a heat flow path is defined between the mounting can and the light emitting diode module and said mounting can, said locking ring, said base ring, and said collar for maintaining a temperature of the light emitting diode module within a predetermined temperature range while the light emitting diode module is adjustably supported by the collar.

According to another aspect of the present invention, there is provided an adjustable light emitting diode lighting assembly, comprising: a primary heat sink member adapted to be mounted in a recessed ceiling housing; a first supplemental heat sink member adapted to be mounted to the primary heat sink member; a second supplemental heat sink member adapted to be spaced-apart from the first supplemental heat sink member; and a secondary heat sink member adapted to be coupled to the first supplemental heat sink member and the second supplemental heat sink member and interposed therebetween for adjustably supporting a light emitting diode module over a plurality of light distribution angles, whereby a heat flow path is defined between the primary heat sink member and the light emitting diode module for maintaining a temperature of the light emitting diode module within a predetermined temperature range while the light emitting diode module is adjustably supported by the secondary heat sink member.

According to yet another aspect of the present invention there is provided an adjustable light emitting diode lighting assembly, comprising: a primary heat sink member adapted to be movably mounted in a recessed ceiling housing; an upper heat sink member mounted to the primary heat sink member; a lower heat sink member spaced-apart from the upper heat sink member; and a toroidal heat sink member adapted to be mounted for pivotal movement between the upper heat sink member and the lower heat sink member, the upper heat sink member and the lower heat sink member being secured substantially airtight in the primary heat sink member.

According to a further aspect of the present invention there is provided a kit for retrofitting a ceiling mounted lighting assembly, comprising: a mounting can adapted to be mounted in a housing; an upper locking ring adapted to be mounted to the mounting can; a lower base ring adapted to be spaced-apart from the upper locking ring; and a collar adapted to be coupled to the upper locking ring and the lower locking ring and interposed therebetween for adjustably supporting a light emitting diode module over a plurality of light distribution angles.

According to an additional aspect of the present invention there is provided an adjustable light emitting diode lighting system, comprising: a mounting can; a first member mountable to the mounting can; a second member associated with the first member; and a toroidal member adapted to be coupled to the first member and the second member, the toroidal third member being adapted to adjustably support a light emitting diode module.

According to yet another aspect of the present invention there is provided an adjustable light emitting diode lighting system, comprising: a primary heat sink member adapted to be mounted in a recessed ceiling housing; a first supplemental heat sink member adapted to be mounted to the primary heat sink member; a second supplemental heat sink member adapted to be spaced-apart from the first supplemental heat sink member; and a secondary heat sink member adapted to be coupled to the first supplemental heat sink member and the second supplemental heat sink member and interposed therebetween for adjustably supporting a light emitting diode module over a plurality of light distribution angles, whereby a heat flow path is defined between the primary heat sink member and the light emitting diode module for maintaining a temperature of the light emitting diode module within a predetermined temperature range while the light emitting diode module is adjustably supported by the secondary heat sink member.

According to a further aspect of the present invention there is provided an adjustable light emitting diode lighting system, comprising: a primary heat sink member adapted to be movably mounted in a recessed ceiling housing; an upper heat sink member mounted to the primary heat sink member; a lower heat sink member spaced-apart from the upper heat sink member; and a toroidal heat sink member mounted for pivotal movement between the upper heat sink member and the lower heat sink member, the upper heat sink member and the lower heat sink member being secured substantially airtight in the primary heat sink member.

According to an additional aspect of the present invention there is provided an adjustable light emitting diode lighting system, comprising: a mounting can adapted to be mounted in a housing; an upper locking ring adapted to be mounted to the mounting can; a lower base ring adapted to be spaced-apart from the upper locking ring; and a collar adapted to be coupled to the upper locking ring and the lower base ring and interposed therebetween for adjustably supporting a light emitting diode module over a plurality of light distribution angles.

According to another aspect of the present invention there is provided a method of assembling an adjustable light emitting diode lighting assembly, comprising: providing a mounting can; providing a first member; mounting the first member to the mounting can; providing a second member associated with the first member; and coupling a toroidal member to the first member and the second member, the toroidal member being adapted to support a light emitting diode module.

According to yet another aspect of the present invention there is provided a method of assembling an adjustable light emitting diode lighting assembly, comprising: providing a primary heat sink member adapted to be movably mounted in a recessed ceiling housing; providing an upper heat sink member adapted to be mounted to the primary heat sink member; providing a lower heat sink member adapted to be spaced-apart from the upper heat sink member; and mounting a toroidal heat sink member to the upper heat sink member and the lower heat sink member for pivotal movement between the upper heat sink member and lower heat sink member, the upper heat sink member and the lower heat sink member being secured substantially airtight in the primary heat sink member.

A feature of the present invention is the provision of a toroidal collar for adjustably supporting a light emitting diode module over a plurality of light distribution angles.

Another feature of the present invention is the provision of a heat sink member for maintaining a temperature of a light emitting diode module within a predetermined temperature range while the light emitting diode module is adjustably supported by the heat sink member.

An additional feature of the present invention is the provision of a housing adapted to be non-airtight for allowing air-flow freely therethrough.

A further feature of the present invention is the provision of a housing adapted to be airtight for preventing air-flow freely therethrough.

Yet another feature of the present invention is the provision of a housing that is one of a plurality of housings adapted to be coupled in series.

Still another feature of the present invention is the provision of a cooling device adapted to be coupled to the plurality of housings for cooling the plurality of housings.

In addition to the foregoing, various other method and/or device aspects and features are set forth and described in the teachings such as text (e.g., claims and/or detailed description) and/or drawings of the present invention.

The foregoing is a summary and thus may contain simplifications, generalizations, inclusions, and/or omissions of detail. Consequently, those skilled in the art will appreciate that the summary is illustrative only and is not intended to be in any way limiting. In addition to the illustrative aspects, embodiments, and features described hereinabove, further aspects, embodiments, and features will become apparent by reference to the drawings and the following detailed description.

BRIEF DESCRIPTION OF THE SEVERAL VIEWS OF THE DRAWINGS

The invention will be more fully understood by reference to the detailed description in conjunction with the following figures, wherein.

DETAILED DESCRIPTION OF THE INVENTION

Figure 1:
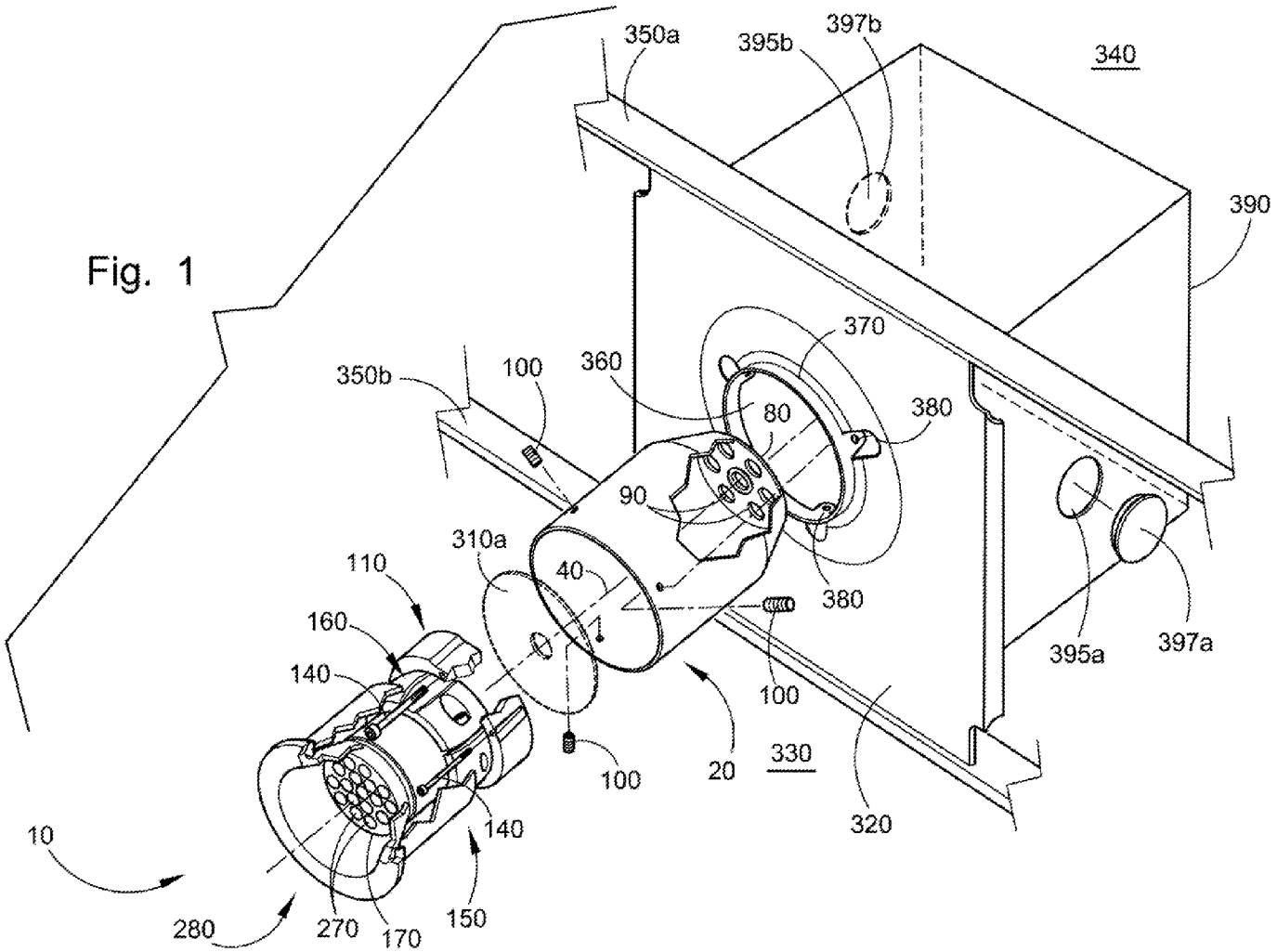
FIG. 1 is an exploded view in perspective of a first embodiment adjustable LED lighting assembly, kit and system oriented for mounting in a recessed ceiling housing.

In the following detailed description, reference is made to the accompanying drawings, which form apart hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from either the spirit or scope of the invention.

In addition, the present patent specification uses formal outline headings for clarity of presentation. However, it is to be understood that the outline headings are for presentation purposes, and that different types of subject matter may be discussed throughout the application (e.g., device(s)/structure(s) may be described under process(es)/operations heading(s) and/or process(es)/operations may be discussed under structure(s)/process(es) headings; and/or descriptions of single topics may span two or more topic headings). Hence, the use of the formal outline headings is not intended to be in any way limiting.

Figure 2:
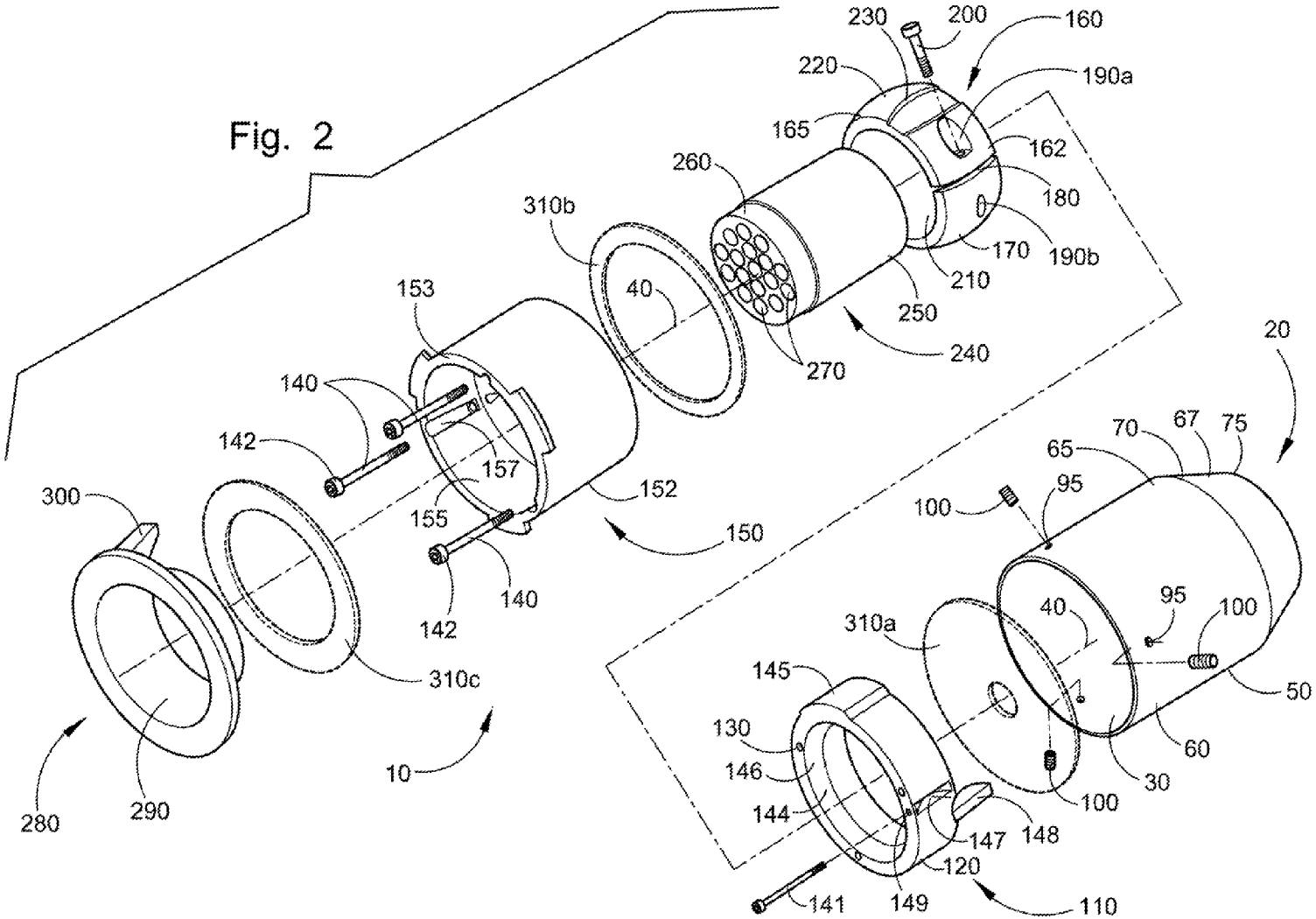
FIG. 2 is an exploded view in perspective of the first embodiment adjustable LED lighting assembly, kit and system that includes a semi-circular or half-moon shaped spacer, shim or adapter.

Therefore, with reference to FIGS. 1 and 2, there is shown a first embodiment adjustable LED lighting assembly, kit and system, generally referred to as 10, for retrofitting an existing ceiling or wall mounted light fixture. First embodiment adjustable LED lighting assembly, kit and system 10 (hereinafter referred to as "first embodiment kit 10") may be used for remodeling and in new building construction, as well as for retrofitting existing ceiling or wall mounted light fixtures, if desired. First embodiment kit 10 may comprise a bullet-shaped, hollow mounting can 20 defining an interior surface 30 therein and a central longitudinal axis 40 therethrough. Mounting can 20 comprises a generally cylindrical and hollow body portion 50 having a proximal end 60 and a distal end 65. Mounting can 20 also comprises a generally frusto-conical nose piece 67 having a proximal end 70 thereof integrally connected to distal end 65 of body portion 50. Nose piece 67 also has a distal end 75, which distal end 75 is of smaller diameter than proximal end 70. Distal end 75 is capped by an end plate 80 which is partially closed. End plate 80 is partially closed in the sense that a plurality of apertures 90 are formed in end plate 80 and are in communication with interior surface 30 of mounting can 20 for reasons provided hereinbelow. Encircling a periphery of proximal end 60 of mounting can 20 are a plurality of spaced-apart holes 95 that receive respective ones of a plurality of set screws 100 for facilitating assembly of first embodiment kit 10. Mounting can 20 is made of a suitable heat conductive material and acts as a primary heat sink member in a manner described in detail hereinbelow. In this regard, mounting can 20 may be made of a suitable heat conductive metal selected from the group consisting essentially of aluminum, steel and mixtures thereof. However, other suitable heat conductive materials may be substituted for the heat conductive metals mentioned immediately hereinabove depending on a particular application. Although mounting can 20 is described herein as being generally bullet-shaped, it should be appreciated by a person skilled in the art of light fixture design that mounting can 20 may have any suitable shape depending on a particular application. Also, it should be appreciated by a person skilled in the art of light fixture design that mounting can 20 may not be included in first embodiment kit 10 when first embodiment kit 10 is used in a retrofit application. This is so because, in a retrofit application, a mounting can may have remained in place following removal of a previously installed light fixture, such as a tungsten incandescent, halogen incandescent or fluorescent light fixture.

Referring again to FIGS. 1 and 2, first embodiment kit 10 also generally includes an annular upper locking ring 110 which is removably mounted to proximal end 60 of mounting can 20. Locking ring 110 is oriented perpendicularly to and center-aligned with longitudinal axis 40, so as to be in alignment with mounting can 20. Locking ring 110 comprises a wall 120 defining a plurality of internally threaded, spaced-apart bolt holes 130 longitudinally therethrough. The plurality of internally threaded bolt holes 130 threadably receive respective ones of a plurality of externally threaded mounting fasteners, such as alien bolts 140. When allen bolts 140 are used, each allen bolt 140 has a radial head portion 142 that is advantageously used in a manner described hereinbelow. For reasons provided hereinbelow, an interior surface 144 of wall 120 may slope inwardly a sufficient distance to form an upper supporting surface portion 146. Wall 120 also has an exterior surface 145. Threaded engagement of allen bolts 140 with bolt holes 130 facilitate assembly of first embodiment kit 10, as described in detail hereinbelow. Moreover, as fully described hereinbelow, locking ring 110 serves as a first supplemental heat sink and is made of the previously mentioned heat conductive metal.

As best seen in FIG. 2, locking ring 110 defines at least one longitudinal cutout 147 that extends from interior surface 144 of locking ring 110 to exterior surface 145 of locking ring 110. For reasons provided momentarily, slidably received in cutout 147 is a spacer or adapter 148, which has a generally "half-moon" or semi-circular shape, for intimately engaging interior surface 30 of mounting can 20, Locking ring 110 further defines a threaded aperture 149 extending from a top surface to a bottom surface of locking ring 110 and intersecting cutout 147. Threaded aperture 149 is adapted to receive an elongate adapter screw, which may be allen bolt 141, having a sufficient length for engaging adapter 148, so as to slidably move adapter 148 outwardly from cutout 147 as allen bolt 140 is received within aperture 149. As adapter 148 moves outwardly from cutout 147, adapter 148 will make intimate surface contact with interior surface 30 of mounting can 20. Such intimate surface contact obtains at least two desirable outcomes. First, movement of adapter 148 outwardly from cutout 147 and into intimate surface contact with interior surface 30 allows first embodiment kit 10 to accommodate or fit tightly within mounting cans 20 of various sizes. Secondly, movement of adapter 148 outwardly from cutout 147 and into intimate surface contact with interior surface 30 provides a heat transfer path for conducting heat from locking ring 110 to mounting can 20.

Referring again to FIGS. 1 and 2, first embodiment kit 10 further includes a generally cylindrical shell or lower base ring 150. The lower base ring 150 has a proximal end 152 and an outwardly projecting flange 153 that radially surrounds proximal end 152 for reasons recited hereinbelow. Base ring 150 is oriented perpendicularly to and center-aligned with longitudinal axis 40, so that base ring 150 is aligned with locking ring 110. Base ring 150 has an interior surface 155 defining a plurality of longitudinally extending, spaced-apart slots 157 therein. Slots 157 slidably receive allen bolts 140 to provide a guide path for unobstructed travel of allen bolts 140 as allen bolts 140 are aligned with and threadably engage bolt holes 130 that extend through wall 120. Moreover, it may be appreciated by a person skilled in the art of light fixture design that a length of each allen bolt 140 is predetermined such that after allen bolts 140 fully threadably engage bolt holes 130, previously mentioned head 142 of each allen bolt 140 will abut, rest against and otherwise intimately engage flange 153 that outwardly projects from proximal end 152 of base ring 150. In this manner, locking ring 110 and base ring 150 are secured one to another in spaced-apart relationship. Thus, slots 157 should be aligned with bolt holes 130 during assembly of first embodiment kit 10. In this manner, the plurality of externally threaded allen bolts 140 will precisely align with and threadably engage internally threaded bolt holes 130. In a manner described in detail hereinbelow, base ring 150 serves as a second supplemental heat sink and is made, of the previously mentioned heat conductive metal.

Still referring to FIGS. 1 and 2, coupled to locking ring 110 and base ring 150 and interposed therebetween is an annular sphere clamp, swivel ring or toroidal collar 160 of variable diameter. In this regard, toroidal collar 160, which forms a part of first embodiment kit 10 and which has a distal end 162 and a proximal end 165, comprises a wall 170 with a longitudinal space or gap 180 therethrough. Wall 170 also includes a pair of opposing internally threaded transverse cutouts 190*a* and 190*b* sized to threadably receive an adjustment means, such as an externally threaded adjustment allen bolt 200, for varying or adjusting the variable diameter of toroidal collar 150. Opposing cutouts 190*a* and 190*b* are located on either side of gap 180, as shown. For reasons provided hereinbelow, gap 180 will decrease in width the further adjustment allen bolt 200 is screwed into cutouts 190*a*/190*b*. As gap 180 decreases in width, diameter of wall 170 will be reduced, thereby causing toroidal collar 160 to contract. Conversely, gap 180 will increase in width the further adjustment allen bolt 200 is unscrewed from cutouts 190*a*/190*b*. As gap 180 increases in width, diameter of wall 170 will be increased, thereby causing toroidal collar 160 to expand. In this manner, adjustment allen bolt 200 is capable of varying or adjusting the variable diameter of toroidal collar 160. In addition, wall 170 of toroidal collar 160 defines an inner surface 210 and an outer surface 220. Outer surface 220 of wall 170 is scored by a plurality of longitudinal grooves 230 spaced-apart around a circumference of wall 170. It may be appreciated by a person skilled in the art of light fixture design that presence of grooves 230 facilitates a more uniform radial contraction and expansion of wall.

Referring yet again to FIGS. 1 and 2, toroidal collar 160 is coupled to locking ring 110 and base ring 150 in a manner such that distal end 162 of toroidal collar 160 is pivotally seated in locking ring 110 and proximal end 165 of toroidal collar 160 is pivotally seated in base ring 150. Toroidal collar 160 is pivotally seated in locking ring 110 and base ring 150 such that toroidal collar 160 is capable of being swiveled up and down with respect to a horizontal axis (not shown) that is perpendicular to longitudinal axis 40. By way of example only, and not by way of limitation, toroidal collar 160 may be swiveled up and down through an angle of about 120 degrees. A generally cylindrical LED module 240 has a distal end 250 and a proximal end 260 and comprises a plurality of LEDs 270 for emitting light. Distal end 250 of LED module 240 is releasibly received in proximal end 165 of toroidal collar 160. Distal end 250 of LED module 240 is releasibly received in proximal end 165 of toroidal collar 160 in the sense that the variable diameter of toroidal collar 160 may be reduced in the manner described hereinabove to grip or secure LED module 240 to toroidal collar 160 and the variable diameter of toroidal collar 160 may be increased in the manner described hereinabove to release LED module 240 from toroidal collar 160.

Still referring to FIGS. 1 and 2, the manner in which LED module 240 is swiveled or adjusted will now be described in detail. In this regard, when LED module 240 is secured to toroidal collar 160, LED module 240 will be able to pivot with and to the same extent as toroidal collar 160 when toroidal collar 160 is pivoted. As previously mentioned, interior surface 144 of wall 120 may slope inwardly a sufficient distance to form an upper supporting surface. Inward sloping of interior surface 147 facilitates swivel movement of LED module 240. In other words, due to the inward sloping of interior surface 147, LED module 240 is capable of being swiveled up and down without obstruction. In this manner, toroidal collar 160 adjustably supports LED module 240, so that light from LEDs 270 may be directed through a plurality of light distribution angles and in a desired direction. As described in detail hereinbelow, toroidal collar 160 serves as a secondary heat sink member and is made of the previously mentioned heat conductive metal. LED module 240 also possesses heat sink capability because LED module 240 comprises the previously mentioned heat conductive metal.

With reference again to FIGS. 1 and 2, a generally annular and decorative trim ring 280 is coupled to base ring 150 for concealing base ring 150 and for providing a pleasing beauty ring against the ceiling or wall surface. Trim ring 280, which is centered along longitudinal axis 40, has a central opening 290 aligned with LEDs 270 for allowing light emitted by LEDs 270 to pass through central opening 290. At least two flexible trim ring clips 300 (only one of which is shown) may upwardly project from an upper surface of trim ring 280 for reasons provided hereinbelow. In addition, a plurality of O-ring gaskets or seal rings 310*a*, 310*b* and 310*c* may be provided, as shown, for helping to ensure that first embodiment kit 10 is substantially airtight. Seal rings 310*a*, 310*b* and 310*c* may be made of any suitable material, such as a polymer. Alternatively, caulking (not shown) rather than seal rings 310*a*/310*b*/310*c* may be used, if desired. Also, as described in detail hereinbelow, trim ring 280 serves as another supplemental heat sink member and is made of the previously mentioned heat conductive metal.

As best seen in FIG. 1, a wall or ceiling panel 320, which forms no part of the present invention, separates a conditioned space 330 (e.g., a room living area) from an unconditioned space 340 (e.g., an attic). Panel 320 may be supported by a pair of parallel joists 350*a* and 350*b* to which panel 320 is connected. Formed in panel 320 is an orifice 360 that may be surrounded by an annular retainer ring 370 located in conditioned space 330. Annular retainer ring 370 comprises retainer means, which may be a plurality of retainers 380, for securing trim ring 280 to panel 320 after a substantial portion of first embodiment kit 10 is inserted through orifice 360 and after trim ring clips 300 are coupled to the portion of panel 320 surrounding orifice 360. Retainer ring 370 supports retainers 380 which receive trim ring clips 300. In this regard, trim ring clips 300 may be sufficiently deformable or bendable to intimately engage retainer ring 370, so that trim ring 280 is securely held against retainer ring 370. More specifically, trim ring clips 300 fit within retainers 380. In addition, a housing 390 may be disposed in unconditioned space 340 and affixed to joists 350*a*/*b*, such as by means of an integral nailer, for housing the substantial portion of first embodiment kit 10 that is inserted through orifice 360. For reasons provided hereinbelow, housing 390 may be provided with at least two cooling ports, such as lower fluid intake port 395*a* and upper fluid exhaust port 395*b*. During normal stand alone operation, at least two sealing caps 397*a* and 397*b* are sealingly received in respective ones of cooling ports 395*a* and 395*b* for sealing cooling ports 395*a* and 395*b*. In this regard, first embodiment kit 10 is airtight when sealing caps 397*a* and 397*b* are present, so as to seal cooling ports 395*a* and 395*b*. Conversely, first embodiment kit 10 is non-airtight when sealing caps 397*a* and 397*b* are absent, so as to unseal cooling ports 395*a* and 395*b*. Moreover, it should be understood by a person having skill in the art of light fixture design that LEDs 270 are electrically connected, such as by means of at least one electrical conducting wire (not shown), to a power supply (also not shown) for electrically energizing LEDs 270. Such electrical conducting wire will be threaded through any one of the plurality of apertures 90 that are formed through end plate 80 that belongs to mounting can 20. The remaining apertures 90 serve as paths for passage of heat by means of radiative heat transfer upwardly from the interior of mounting can 20.

Still referring to FIG. 1, it may be appreciated that first embodiment kit 10 serves at least two functions. First, first embodiment kit 10 allows LED module 230 to be swiveled into a desired position during installation of first embodiment kit 10 in panel 320, so that light from LED module 230 may be directed and fixed in a desired direction. Secondly, first embodiment kit 10 comprises radiative and conductive heat transfer structure for conducting heat away from LEDs 270, so that LEDs 270 will maintain desired luminous efficiency and service life.

Figure 3:
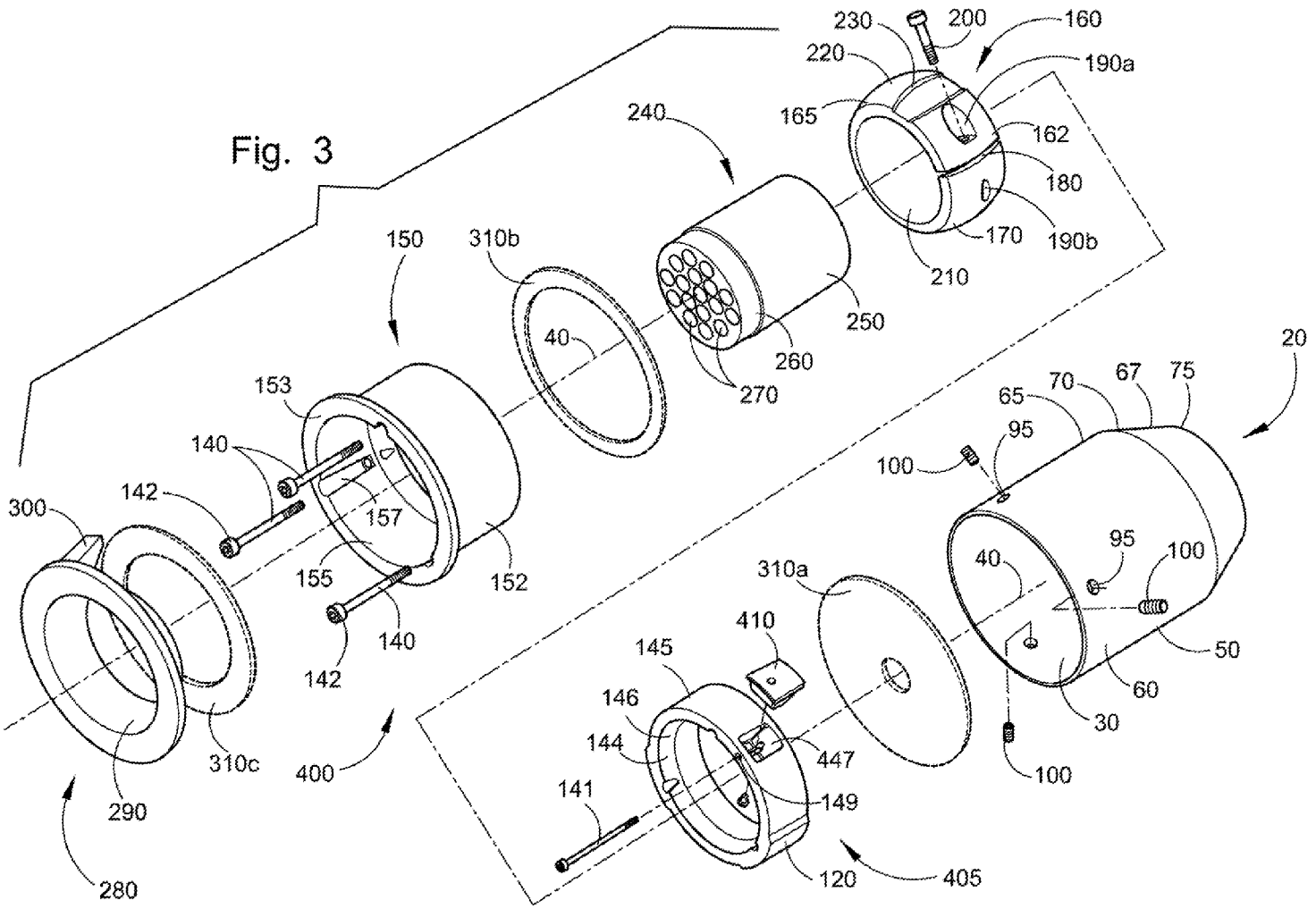
FIG. 3 is an exploded view in perspective of a second embodiment adjustable LED lighting assembly, kit and system that includes a parallelepiped or wedge-shaped spacer, shim or adapter.

Turning now to FIG. 3, there is shown a second embodiment adjustable LED lighting assembly, kit and system, generally referred to as 400, for retrofitting an existing ceiling or wall mounted light fixture. Second embodiment adjustable LED lighting assembly, kit and system 400 (hereinafter referred to as "second embodiment kit 400") may be used for remodeling and in new building construction, as well as for retrofitting existing ceiling or wall mounted light fixtures, if desired. Second embodiment kit 400 is substantially similar to first embodiment kit 10, except that a second embodiment locking ring 405 comprises a second embodiment spacer or adapter 410, which is generally "wedge-shaped". Cutout 447 is sized to matingly slidably receive adapter 410. Adapter 410 is slidably movable outwardly from cutout 447 in the manner disclosed hereinabove for the case of first embodiment adapter 148. That is, adapter 410 is slidably movable outwardly from cutout 447 by the action of an adapter screw, such as adapter screw 141. As adapter 410 moves outwardly from cutout 447, adapter 410 will make intimate surface contact with interior surface 30 of mounting can 20 to accommodate mounting cans 20 of various sizes and to enhance conductive heat transfer. Also, adapter 410 will not fall out of cutout 447 during shipment of second embodiment kit 400. A small holder (not shown) retains adapter 410 within cutout 447.

Figure 4:
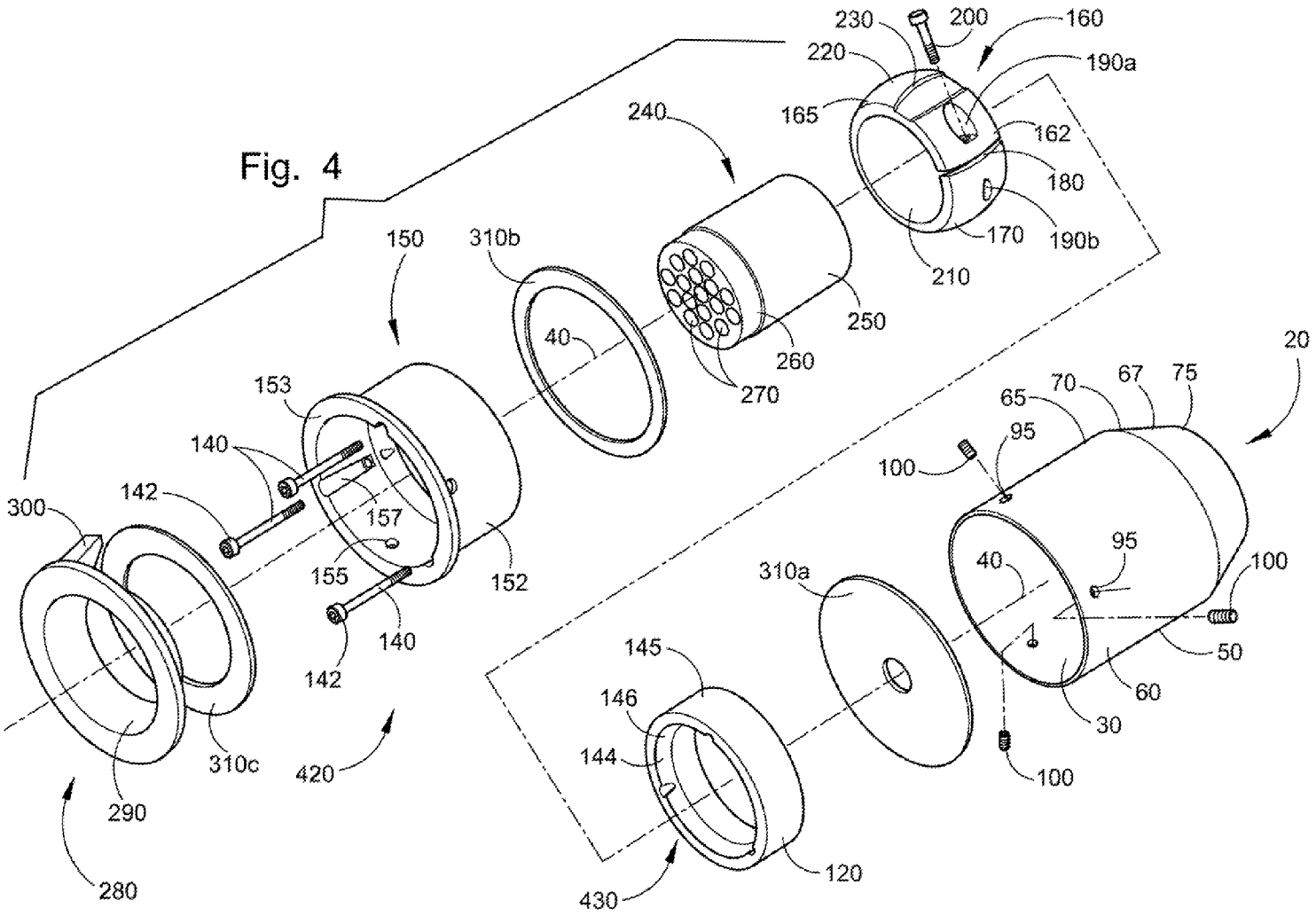
FIG. 4 is an exploded view in perspective of a third embodiment adjustable LED lighting assembly, kit and system having an adaptor-free configuration.

Referring to FIG. 4, there is shown a third embodiment adjustable LED lighting assembly, kit and system, generally referred to as 420, for retrofitting an existing ceiling or wall mounted light fixture. Third embodiment adjustable LED lighting assembly, kit and system 420 (hereinafter referred to as "third embodiment kit 420") may be used for remodeling and in new building construction, as well as for retrofitting existing ceiling or wall mounted light fixtures, if desired. Third embodiment kit 420 is substantially similar to first embodiment kit 10, except that a third embodiment locking ring 430 lacks cutout 137 and also lacks an adapter, so that third embodiment kit 420 is adapter-free. In this regard, locking ring 430 is secured within can 20 by means of a "compression" or press-fit. Elimination of a need for cutout 137 and adapters 148/410 may provide a, savings in material and reduction in complexity of installation.

Figure 5:
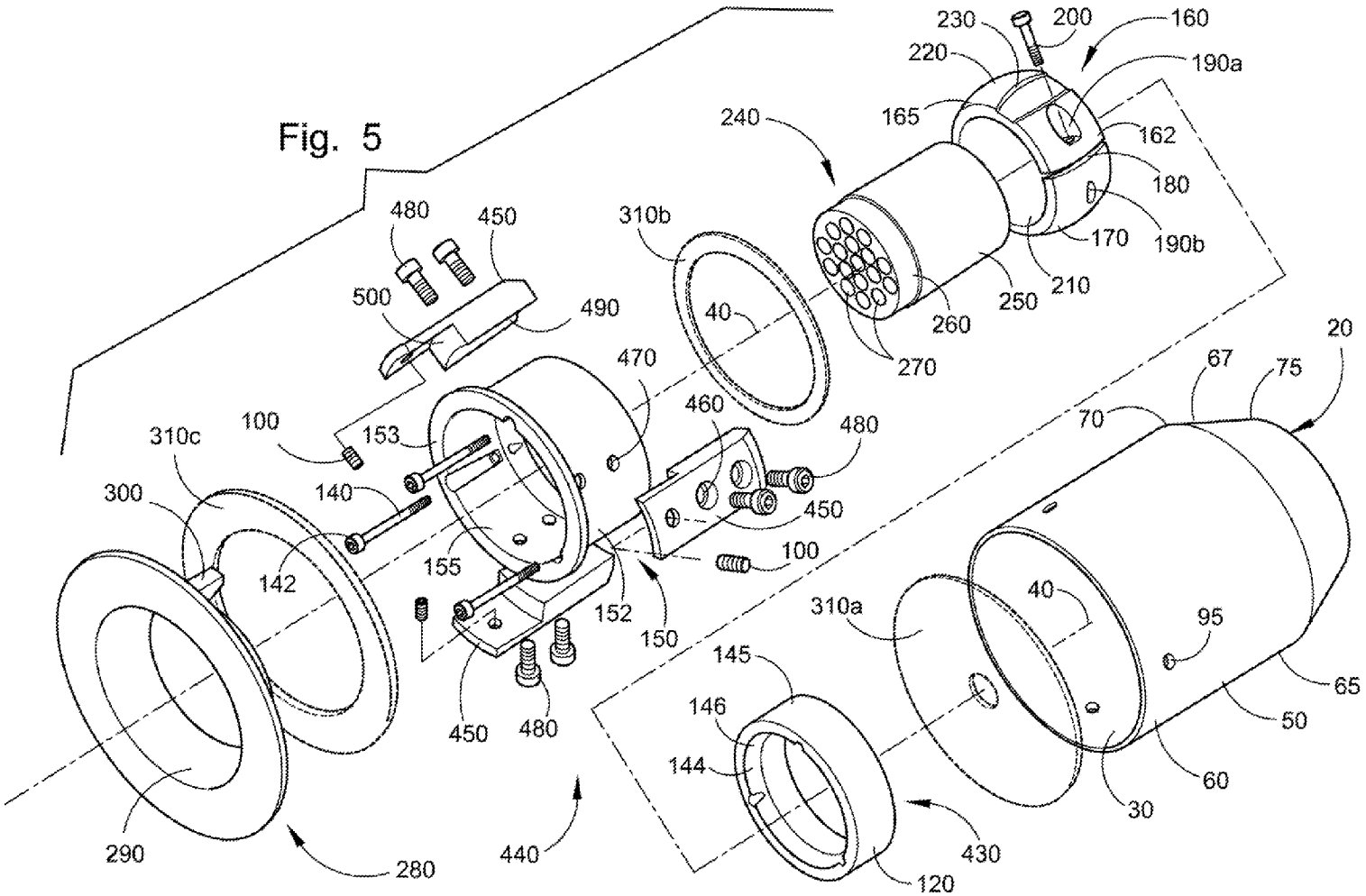
FIG. 5 is an exploded view in perspective of a fourth embodiment adjustable LED lighting assembly, kit and system having a plurality of leg adapters.

Referring to FIG. 5, there is shown a fourth embodiment adjustable LED lighting assembly, kit and system, generally referred to as 440, for retrofitting an existing ceiling or wall mounted light fixture. Fourth embodiment adjustable LED lighting assembly, kit and system 440 (hereinafter referred to as "fourth embodiment kit 440") may be used for remodeling and in new building construction, as well as for retrofitting existing ceiling or wall mounted light fixtures, if desired. Fourth embodiment kit 440 is substantially similar to third embodiment kit 420, except that fourth embodiment kit 440 comprises a plurality of generally rectangular spacers, shims or leg adapters 450 surrounding and connected to an exterior surface of lower base ring 150. More specifically, each leg adapter 450 defines at least one bore 460 therethrough that is alignable with a corresponding threaded hole 470 formed through lower base ring 150. A threaded bolt 480 extends through bore 460 and into threaded hole 470 for coupling leg adapter 450 to lower base ring 150. Each leg adapter 450 may define a curved surface 490 thereon for conforming to the exterior surface of generally cylindrical lower base ring 150. In addition, each leg adapter 450 may further define a step 500 formed therein. Step 500 rests against an upper surface of previously mentioned flange 153 that belongs to lower base ring 150. A purpose of step 500 is to prevent inadvertent rotation of leg adapter 450 while leg adapter 450 is being connected to the exterior surface of lower base ring 150. It should be appreciated that loosening of threaded bolt 480 from threaded hole 470 allows leg adapter 450 to be outwardly translated, so as to intimately engage interior surface 30 of can 20. Such an intimate engagement of leg adapter 450 with interior surface 30 while remaining connected to lower base ring 150 allows fourth embodiment kit 440 to accommodate mounting cans 20 of various diameters. In addition, movement of leg adapter 450 outwardly from lower base ring 150 and into intimate surface contact with interior surface 30 provides a heat transfer path for conducting heat from lower base ring 110 to mounting can 20.

As previously mentioned, heat removal from LED module 240 maintains and/or enhances luminous efficiency and service life of LEDs 270 that are disposed in LED module 240. This is particularly important during warm weather atmospheric conditions. In this regard, in addition to the passive cooling configurations described hereinabove, the invention may also use active cooling configurations that augment the passive cooling configurations for heat removal. Therefore, as described in detail hereinbelow, applicants provide an "open-loop" cooling configuration and "closed-loop" cooling configuration of the invention for heat removal using active cooling of LED module 240.

Figure 6:
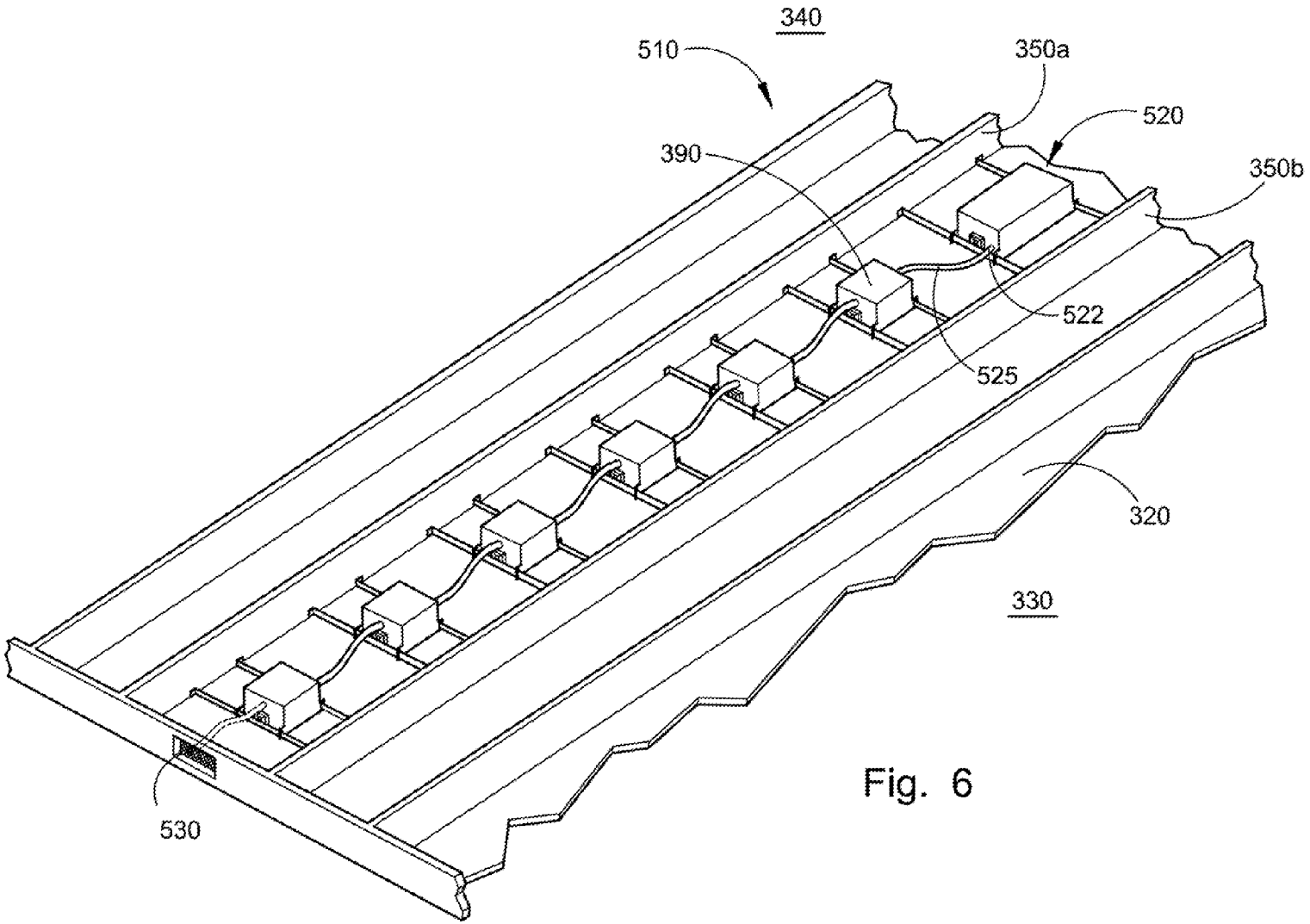
FIG. 6 is a view in perspective of a fifth embodiment adjustable LED lighting assembly, kit and system that includes a plurality of housings coupled in series and arranged in an open-loop cooling configuration.

Therefore, referring now to FIG. 6, there is shown an "open-loop" fifth embodiment adjustable LED lighting assembly, kit and system, generally referred to as 510, for retrofitting an existing ceiling or wall mounted light fixture. Fifth embodiment adjustable LED lighting assembly, kit and system 510 (hereinafter referred to as "fifth embodiment kit 510") may be used for remodeling and in new building construction, as well as for retrofitting existing ceiling or wall mounted light fixtures, if desired. As described in detail hereinbelow, this fifth embodiment kit 510 comprises a plurality of housings 390 coupled in series to a cooling module or device, generally referred to as 520, that actively delivers a cooling fluid (e.g., air) to housings 390. It may be appreciated that housings 390 can accommodate any of the kit embodiments mentioned herein, and most preferably fourth embodiment kit 440.

Referring again to FIG. 6, the structure and operation of fifth embodiment kit 510 will now be described. In this regard, a plurality of housings 390 are connected in series to cooling device 520, which may comprise a blower or fan, for once-through passage of cooling air through housings 390. More specifically, previously mentioned sealing caps 397*a* and 397*b* are removed from respective ones of lower fluid intake port 395*a* and upper fluid exhaust port 395*b* (see FIG. 1) of all housings 390 that are arranged in the series. As shown in FIG. 6, an output port 522 in cooling device 520 is sealingly connected, such as by a suitable conduit or duct segment 525, to intake port 395*a* of the first housing 390 in the series. Exhaust port 395*b* of first housing 390 is connected by another duct segment 525 to intake port 395*a* of a second housing 390 in the series. This lower to upper connection configuration is repeated between individual housings 390 until a last exhaust port 395*b* of the last housing 390 in the series is connected to a ventilation port 530 that is open to an external or outside atmosphere. Therefore, this fifth embodiment of the invention defines the open-loop cooling system for removing the heat generated by LED module 240. More specifically, heat generated by LED module 240 is radiated and conducted away from LED module 240 by means of the previously mentioned heat conductive metal used in the adjustable LED kits. The heat radiated and conducted away from LED module 240 is received into housing 390. At that point, the heat is carried away from housing 390 by forced air convection due to presence of cooling device 520 and duct segments 525.

Still referring to FIG. 6, fifth embodiment kit 510 is configured such that, when any one of LED modules 240 in the series is activated, cooling device 520 is also activated to silently pass cooled air through duct segments 525 and, thus, through the array of air-cooled housings 390. In this manner, each LED modules 240 in the series will operate within its ideal or nominal temperature range in super heated environments where, for example, the outside temperature exceeds 100° F. Operation of LED module 340 within its ideal or nominal temperature range ensures that each LED module 240 will maintain its intended luminous efficiency and life span. Moreover, by providing cooled air to each LED module 240, each LED module 240 will maintain the quality and intensity of light throughout the LED module's 240 intended life span. It should be understood by a person skilled in the art of light fixture design, that larger cooling devices 520 may be utilized with larger air-cooled housings 390. Also, by way of example only and not by of limitation, there may be an array of six air-cooled housings 390 coupled in series. Alternatively, an array of more than six air-cooled housings 390 may be configured by breaking-up or segregating the arrays into groups of six for use with cooling device 520.

Figure 7:
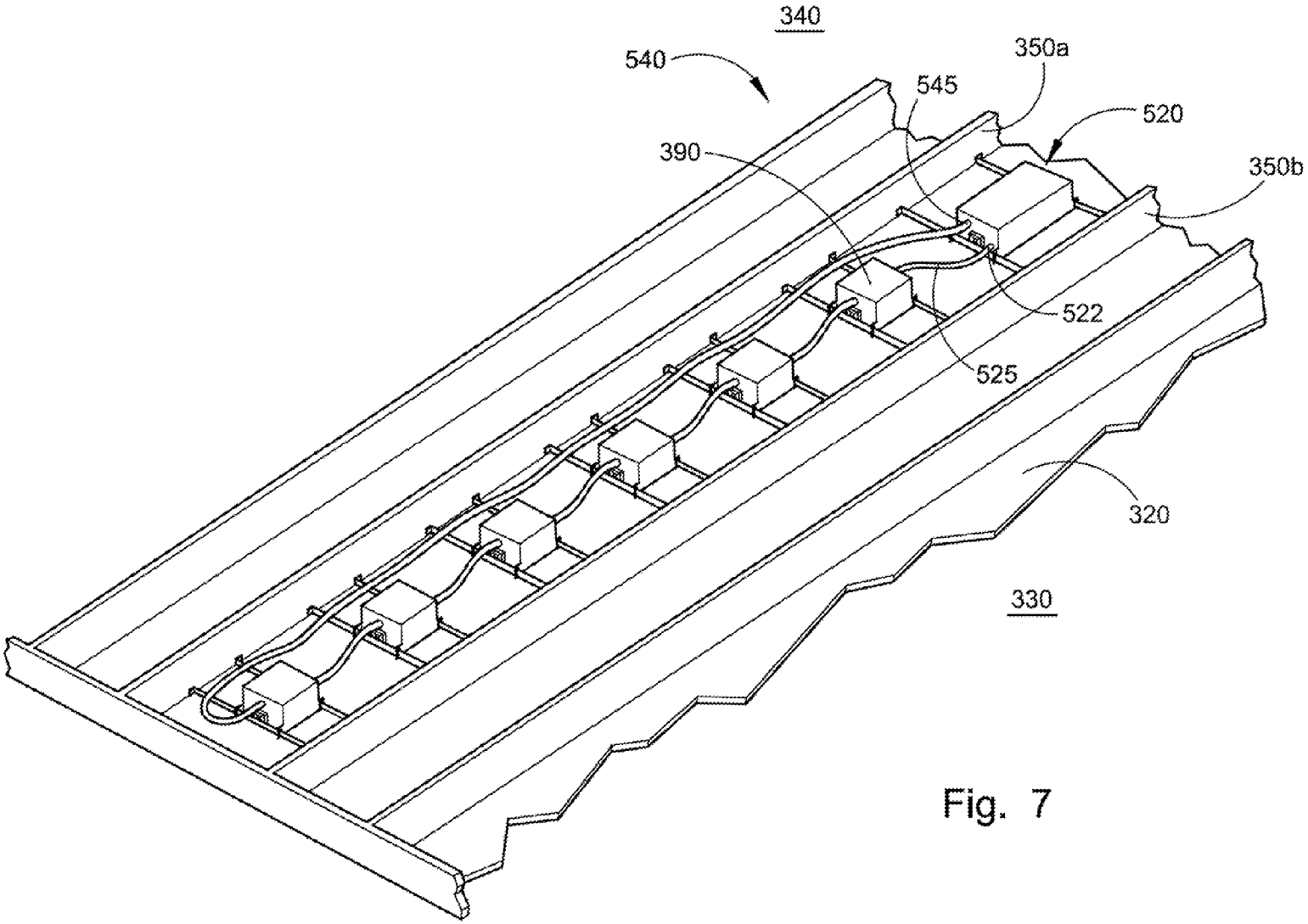
FIG. 7 is a view in perspective of a sixth embodiment adjustable LED lighting assembly, kit and system including a plurality of housings coupled in series and arranged in a closed-loop cooling configuration.

Referring to FIG. 7, there is shown a "closed-loop" sixth embodiment adjustable LED lighting assembly, kit and system, generally referred to as 540, for retrofitting an existing ceiling or wall mounted light fixture. Sixth embodiment adjustable LED lighting assembly, kit and system 540 (hereinafter referred to as "sixth embodiment kit 540") may be used for remodeling and in new building construction, as well as for retrofitting existing ceiling or wall mounted light fixtures, if desired. This sixth embodiment kit 540 is substantially similar to fifth embodiment kit 510, except that one of duct segments 525 connects last exhaust port 395*b* of the last housing 390 in the series to an input port 545 of cooling device 520. In this sixth embodiment kit 540, ventilation port 530 need not be present. In this manner, cooling device 520 and ducts 525 cooperate to recirculate cooling air through housings 390. Use of sixth embodiment kit 540 may be particularly beneficial in applications where access to ventilation port 530 is inconvenient or not possible.

Figures 8, 9:
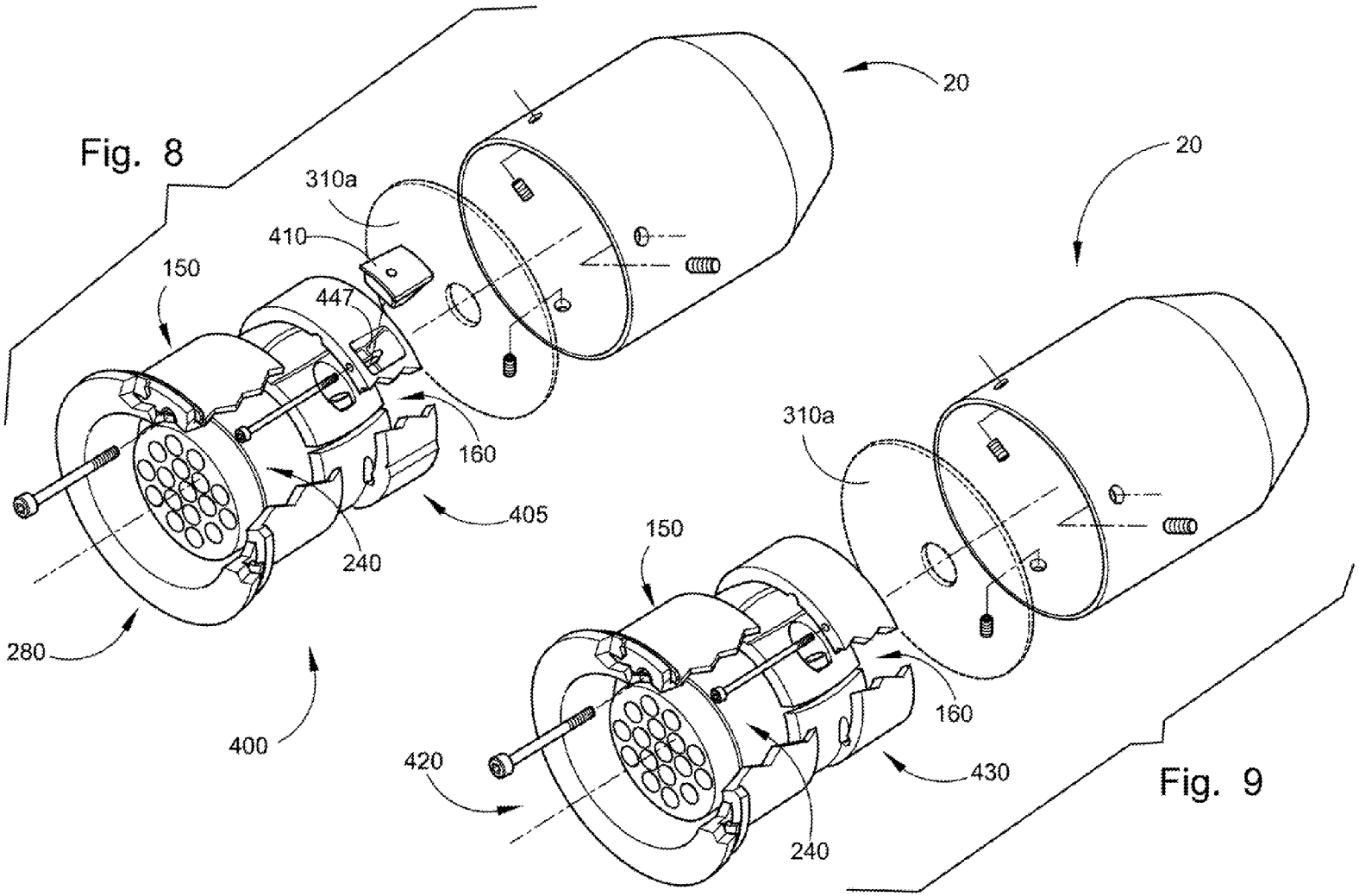
FIG. 8 is a partially exploded (i.e., partially assembled) view in perspective of the second embodiment adjustable LED lighting assembly, kit and system that includes a wedge-shaped spacer or shim.
FIG. 9 is a partially exploded (i.e., partially assembled) view in perspective of the third embodiment adjustable LED lighting assembly, kit and system having an adaptor-free configuration.
Figure 10:
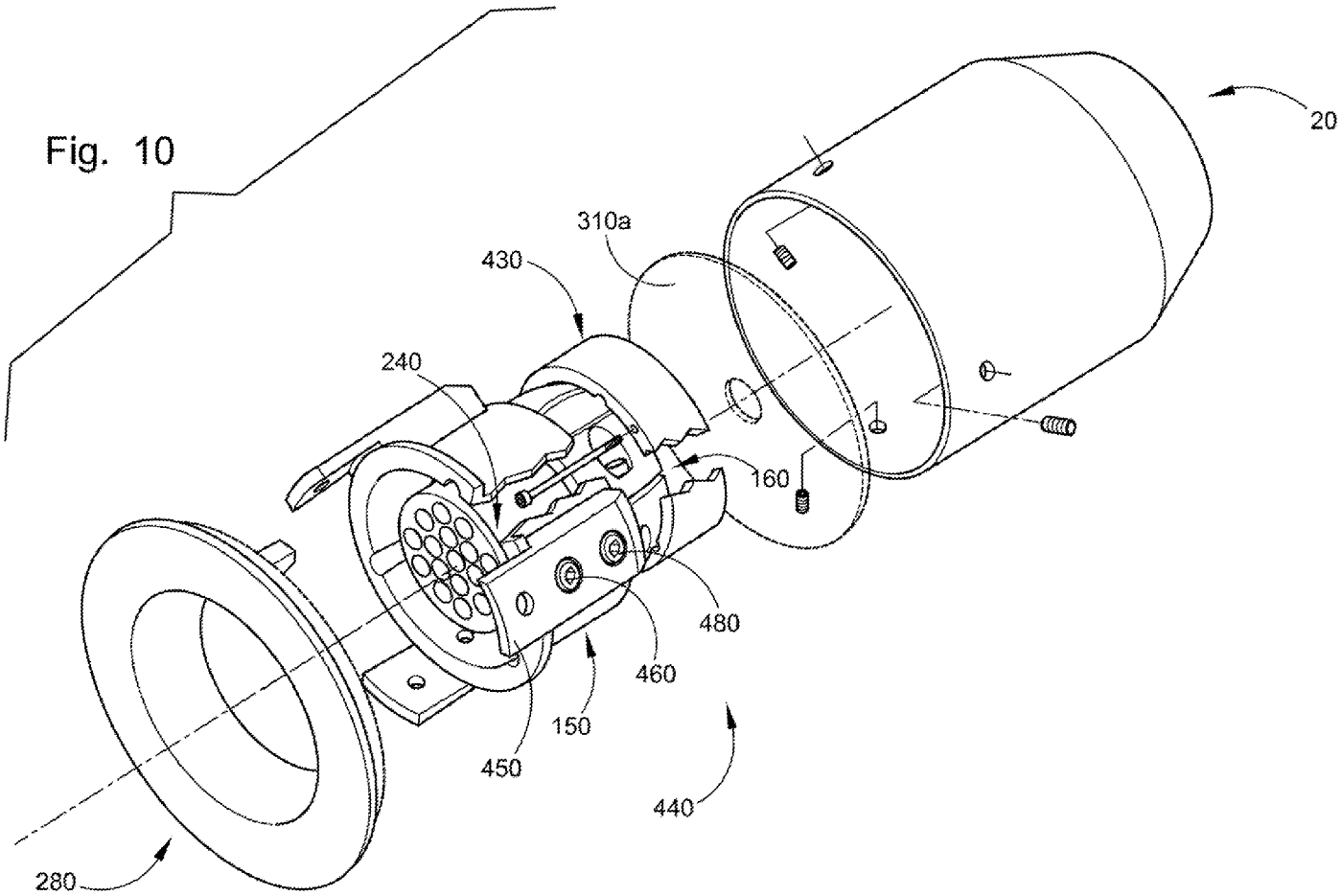
FIG. 10 is a partially exploded (i.e., partially assembled) view in perspective of the fourth embodiment adjustable LED lighting assembly, kit and system having a plurality of leg adapters.

FIGS. 8, 9 and 10 merely illustrate, for purposes of clarity, partially exploded (i.e., partially assembled) views of second embodiment kit 400, third embodiment kit 420 and fourth embodiment kit 440, respectively. The partially exploded (i.e., partially assembled) views of first embodiment kit 10 were previously illustrated in FIGS. 1 and 2.

Illustrative Methods

Illustrative methods associated with exemplary embodiments for assembling an adjustable LED lighting assembly will now be described.

Figure 11:
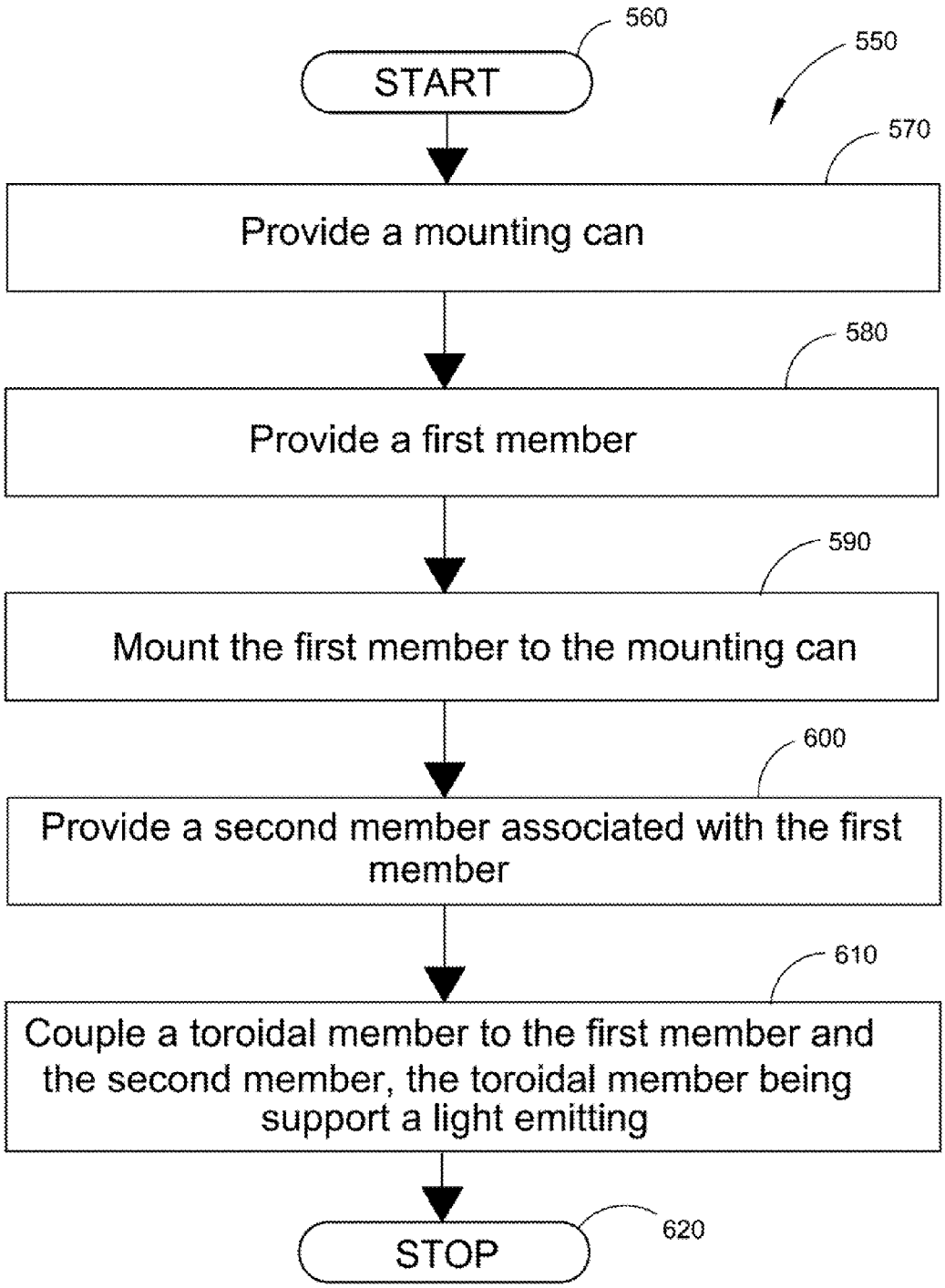
FIGS. 11 through 14 are flowcharts of illustrative methods of assembling the adjustable LED lighting assembly.

Referring to FIG. 11, an illustrative method 550 that is provided for assembling an adjustable light emitting diode lighting assembly starts at a block or step 560. At a block or step 570, a mounting can is provided. At a block or step 580, a first member is provided. At a block or step 590, the first member is mounted to the mounting can. At a block or step 600, a second member associated with the first member is provided. At a block or step 610, a toroidal member is coupled to the first member and the second member, the toroidal member being adapted to support a light emitting diode module. The method stops at a block or step 620.

Figure 12:
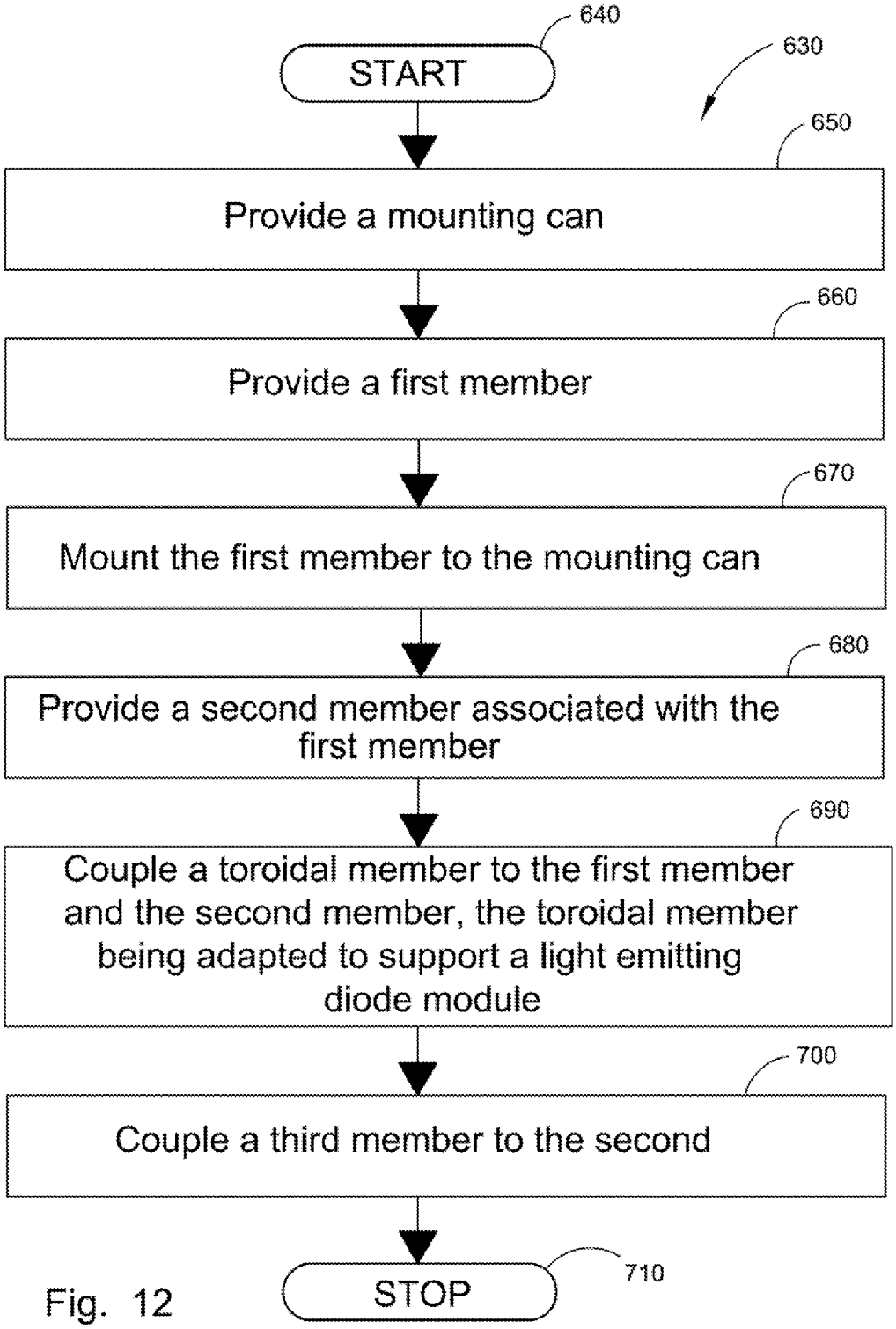

Referring to FIG. 12, an illustrative method 630 that is provided for assembling an adjustable light emitting diode lighting assembly starts at a block or step 640. At a block or step 650, a mounting can is provided. At a block or step 660, a first member is provided. At a block or step 670, the first member is mounted to the mounting can. At a block or step 680, a second member associated with the first member is provided. At a block or step 690, a toroidal member is coupled to the first member and the second member, the toroidal member being adapted to support a light emitting diode module. At a block or step 700, a third member is coupled to the second member. The method stops at a block or step 710.

Figure 13:
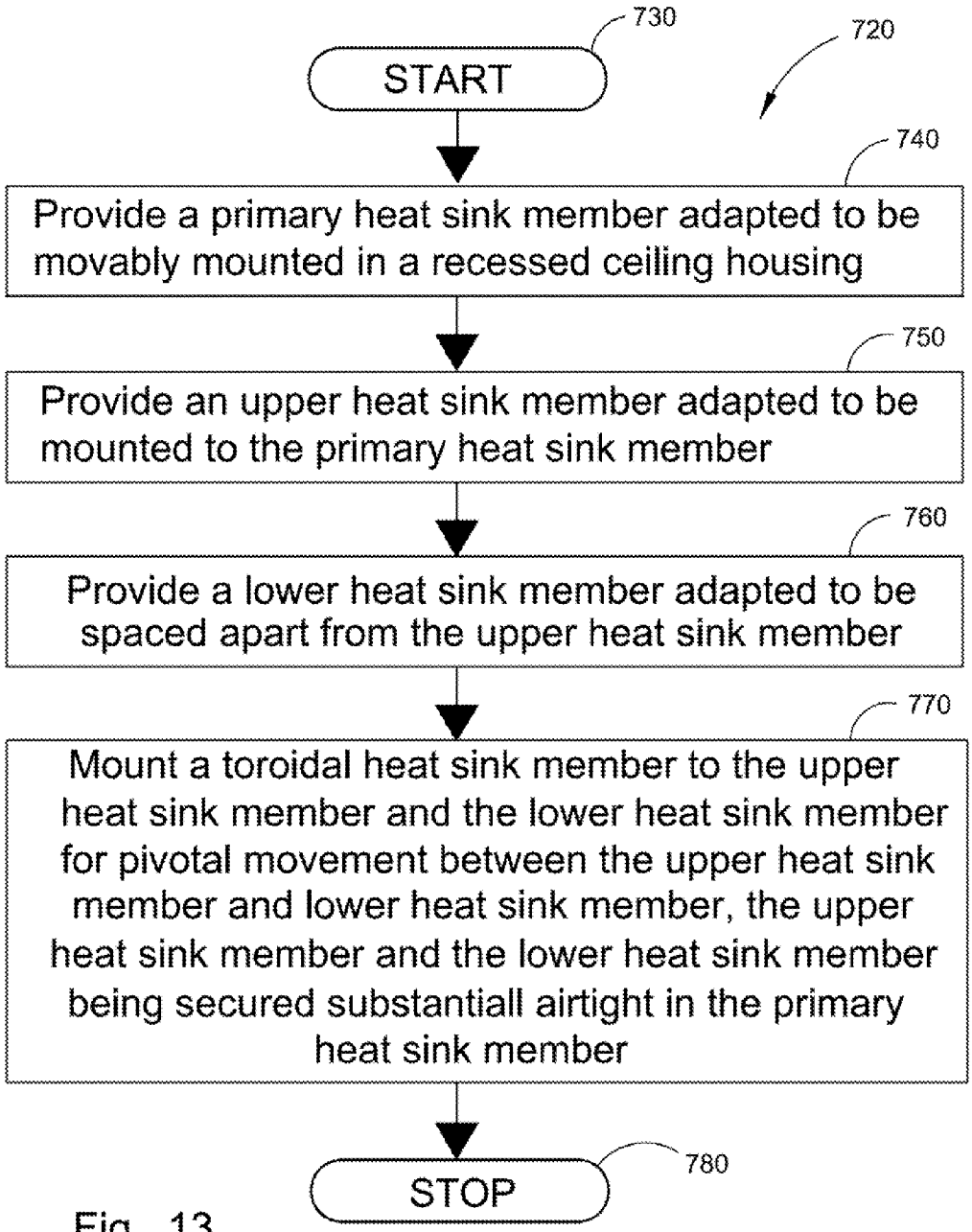

Referring to FIG. 13, an illustrative method 720 that is provided for assembling an adjustable light emitting diode lighting assembly starts at a block or step 730. At a block or step 740, a primary heat sink member adapted to be movably mounted in a recessed ceiling housing is provided. At a block or step 750, an upper heat sink member adapted to be mounted to the primary heat sink member is provided. At a block or step 760, a lower heat sink member adapted to be spaced-apart from the upper heat sink member is provided. At a block or step 770, a toroidal heat sink member is mounted to the upper heat sink member and the lower heat sink member for pivotal movement between the upper heat sink member and lower heat sink member, the upper heat sink member and the lower heat sink member being secured substantially airtight in the primary heat sink member. The method stops at a block or step 780.

Figure 14:
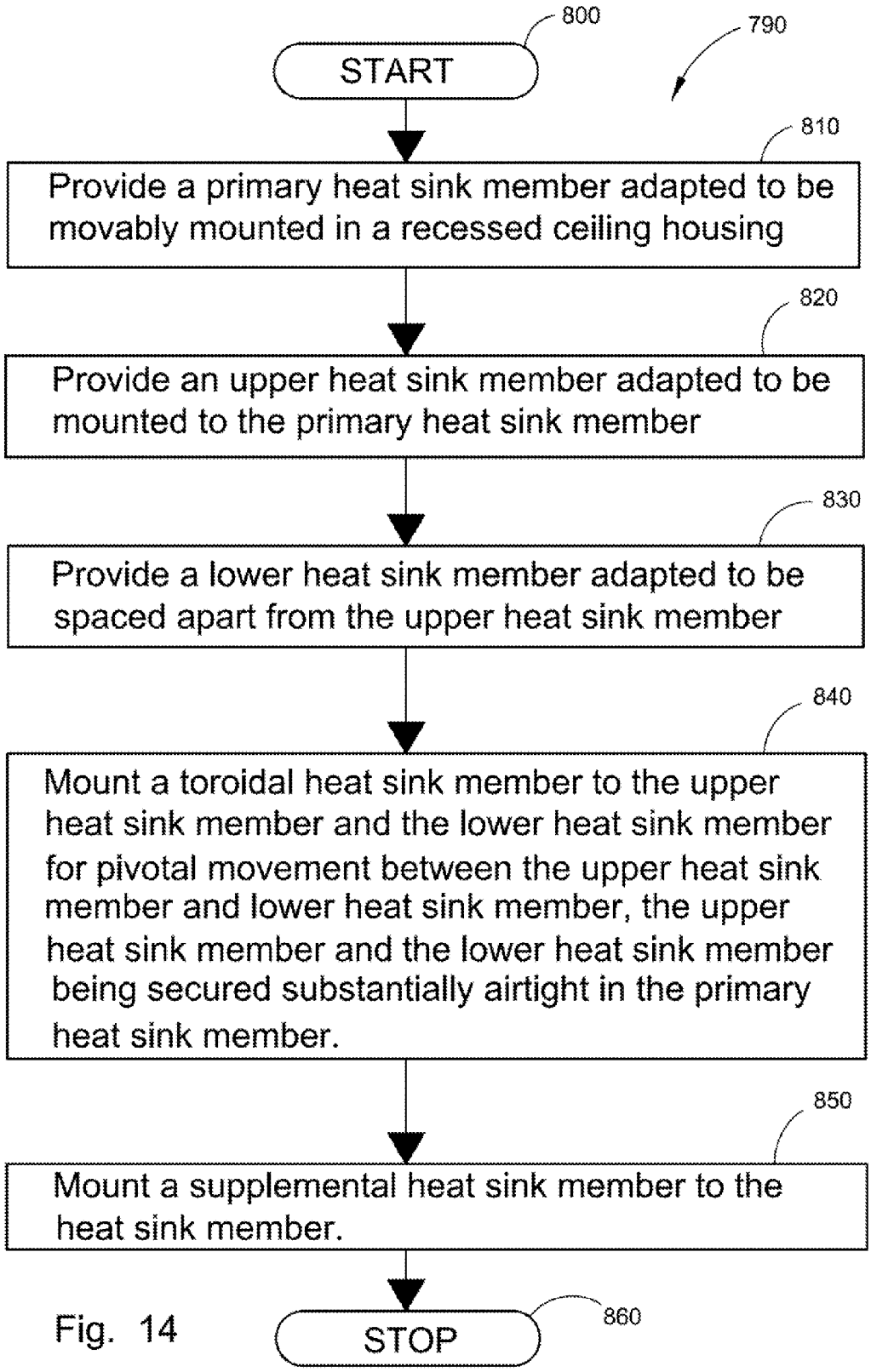

Referring to FIG. 14, an illustrative method 790 that is provided for assembling an adjustable light emitting diode lighting assembly starts at a block or step 800. At a block or step 810, a primary heat sink member adapted to be movably mounted in a recessed ceiling housing is provided. At a block or step 820, an upper heat sink member adapted to be mounted to the primary heat sink member is provided. At a block or step 830, a lower heat sink member adapted to be spaced-apart from the upper heat sink member is provided. At a block or step 840, a toroidal heat sink member is mounted to the upper heat sink member and the lower heat sink member for pivotal movement between the upper heat sink member and lower heat sink member, the upper heat sink member and the lower heat sink member being secured substantially airtight in the primary heat sink member. At a block or step 850, a supplemental heat sink member mounted to the lower heat sink member. The method stops at a block or step 860.

It may be appreciated from the description hereinabove that heat transfer from LED module 240 in first embodiment kit 10, second embodiment kit 410, third embodiment kit 420, fourth embodiment kit 440, fifth embodiment kit 510 and sixth embodiment kit 540 is accomplished by either conduction, radiation or convection or by a combination of conduction, radiation and convection. More specifically, conductive heat transfer occurs by metal-to-metal surface contact, radiative heat transfer occurs at least by heat rising into housing 390 from LED module 240 and convective heat transfer occurs by operation of cooling device 520. These modes of heat transfer, either singly or in combination, facilitate effective removal of heat from LED module 240 to enhance luminous efficiency and service life of LED module 240.

Other modifications and implementations will occur to those skilled in the art without departing from the spirit and, the scope of the invention as claimed. For example, the present invention may be used for tungsten incandescent, halogen incandescent and fluorescent light fixtures, as well as for LED light fixtures, if desired. Accordingly, the description hereinabove is not intended to limit the invention, except as indicated in the following claims.

Therefore, provided herein are an adjustable LED lighting assembly, kit and system and method of assembling an adjustable LED lighting assembly.

What is claimed is:

1. An adjustable light emitting diode lighting assembly, mountable in a light fixture housing mounting can having a central longitudinal axis, the assembly comprising:

an annular upper locking ring press fit into the mounting can;

a lower base ring aligned with said upper locking ring in a spaced-apart relationship;

a generally cylindrical light emitting diode module having a distal end and a proximal end;

a toroidal shaped collar interposed in alignment between said upper lacking ring and said lower base ring;

said toroidal shaped collar having a proximal end, and a distal end;

wherein said distal end of said light emitting diode module is received within said proximal end of said toroidal shaped collar at its proximal end;

wherein said proximal end of said light emitting diode module is received within said toroidal shaped collar at its distal end;

wherein said proximal end of said toroidal shaped collar is pivotally seated in said upper locking ring;

wherein said distal end of said toroidal shaped collar is pivotally seated in said lower base;

wherein said light emitting diode module is supported in said toroidal shaped collar so that said module and said toroidal collar swivel up and down to the same extent when said toroidal collar is swiveled; and wherein said locking ring, said base ring, said collar and said light emitting diode module are coupled together to form the adjustable light emitting diode lighting assembly.

2. The assembly of claim 1, further comprising:

an alignment screw for varying a diameter dimension of said collar to release said collar from and retain said collar to the light emitting diode module.

3. The assembly of claim 2, wherein said lower base ring includes a plurality of longitudinally extending, spaced apart slots for slidably receiving therein respective ones of a plurality of mounting fasteners to facilitate securing together in said spaced apart relationship said upper locking ring and said lower base.

4. An adjustable light emitting diode lighting assembly, comprising:

a light emitting diode module including an LED array mounted to a generally cylindrically shaped LED bearing structure having a distal end and a proximal end;

a heat sink member defining a variable diameter toroidal collar for releasably gripping and securing said light emitting diode module in perpendicular center alignment within said collar;

said variable diameter toroidal collar mounted for swivel movement between a first supplemental heat sink member defining an upper ring member and a second supplemental heat sink member defining a lower ring member, said collar being pivotally seated by a distal end thereof against said lower ring member and being pivotally seated by a proximal end thereof against said upper ring member; and wherein said variable diameter toroidal collar, said upper ring member, and said lower ring member are mounted adjustably together center aligned on a common longitudinal axis to form the adjustable light emitting diode assembly.

5. The assembly of claim 4, further comprising:

a plurality of step shaped shim members mounted spaced apart around a circumference exterior surface of said lower ring member;

said step shaped shim members each being mounted for outward translated movement a sufficient distance to intimately engage an interior wall surface of a ceiling fixture mounting can and to establish a heat transfer path for conducting heat from said lower ring to said mounting can;

wherein said variable diameter toroidal collar defining a wall having a gap disposed therein to facilitate radial contraction and expansion of said wall;

said wall having a plurality of longitudinal grooves spaced-apart around a circumference of said wall to facilitate a substantially uniform radial contraction and expansion of said wall;

wherein said upper ring member is removably mounted to a proximal end of said mounting can perpendicular to and center aligned on said common longitudinal axis to establish another heat transfer path for conducting heat from said upper ring to said mounting can;

wherein said upper ring defines an annular wall having an interior surface sloping inwardly a sufficient distance to form an upper supporting surface for pivotally seating a distal end portion of said variable diameter toroidal ring thereon; and wherein said toroidal collar may be swiveled up and down through an angle of about 120 degrees as it supports said light emitting diode module to facilitate directing light from said light emitting module through a plurality of light distribution angles in a desired lighting direction.

6. An adjustable light emitting diode lighting assembly, comprising:

a toroidal heat sink member adjustably supporting therein a light emitting diode module;

an upper heat sink member having an inwardly sloping wall member to facilitate supporting thereon one end of said toroidal heat sink member for swiveling movement;

a lower heat sink member spaced apart from said upper heat sink member said lower heat sink member supporting another end of said toroidal heat sink member for swiveling movement;

said toroidal heat sink member, said light emitting diode module, said upper heat sink member and said lower heat sink member being coupled together to form the adjustable light emitting diode lighting assembly; and said toroidal heat sink member having a variable diameter to releasably secure said light emitting diode module therein and being provided with a plurality of longitudinal grooves spaced-apart around a circumference thereof to facilitate a substantially uniform radial contraction about said light emitting diode module as said toroidal heat sink member is seated in abutting engagement with both, said upper heat sink member and said lower heat sink.

7. The assembly of claim 6, further comprising:

a plurality of shims disposed spaced apart about the circumference of said lower heat sink member;

wherein each individual shims has step and a curved interior wall structure conforming to an exterior surface of the lower heat sink member and is outwardly moveable relative to exterior surface to intimately engage an interior surface of a light fixture mounting can to facilitate establishing a heat transfer path from said lower heat sink member to said mounting can.

8. A kit for retrofitting a ceiling mounted lighting assembly, comprising:

a generally cylindrical shaped light emitting diode module;

a collar having an adjustable diameter mounted for up and down swivel motion between a lower base ring and an upper locking ring;

said collar being pivotally seated by a distal end thereof against said lower base ring and being pivotally seated by a proximal end thereof against said upper locking ring; and said collar, said light emitting diode module, said upper locking ring, and said lower base ring being mounted together center aligned on a common longitudinal axis to form an adjustable light emitting diode assembly.

9. An adjustable light emitting diode lighting assembly for insertion into a ceiling fixture mounting can defining a primary heat sink member having a generally cylindrical hollow body construction, the assembly comprising:

an upper locking ring for defining a first supplemental heat sink member adapted to be slidably removably mounted to said primary heat sink member in a friction tight fit to facilitate heat transfer between said first supplemental heat sink member and said primary heat sink member;

an adjustable diameter lower base ring for defining a second supplemental heat sink member adapted to be spaced-apart from said first supplemental heat sink member and slidably removably mounted within said primary heat sink member, said lower base ring having mounted thereto a plurality of spaced apart leg adapters surrounding and connected to an exterior surface of said lower base ring to facilitate adjusting the diameter of said lower base ring, each leg adapter being adjustable outwardly away from said exterior surface of said lower base ring a sufficient distance to intimately engage an interior surface of said primary heat sink member to provide a heat transfer path for conducting heat from said lower base ring to the primary heat sink member; and a variable diameter toroidal collar for defining a secondary heat sink member seated and interposed between said first supplemental heat sink member and said second supplemental heat and dimensioned to adjustably grip and secure therein a light emitting diode module over a plurality of light distribution angles, whereby a heat flow path is defined between said primary heat sink member and the light emitting diode module for maintaining a temperature of the light emitting diode module within a predetermined temperature range while the light emitting diode module is adjustably supported by said secondary heat sink member.

10. The assembly of claim 9, wherein each individual one of said plurality of leg adapters defining a curved surface thereon for conforming to the exterior surface of said lower base ring; and wherein each individual one of said plurality of leg adapters further defining a step, each step resting against an, upper surface of an outwardly projecting flange radially surrounding a proximal end of said lower base ring to substantially prevent rotation of individual ones of the leg adapters as the leg adapter is coupled to said lower base ring; and wherein each leg adapter defining another supplemental heat sink for helping to transfer heat from said lower base ring to the primary heat.

11. The adjustable light emitting diode lighting assembly according to claim 1, further comprising:

a plurality of leg adapters spaced around and coupled to said lower base ring for defining a supplemental heat sink member to help facilitate the transfer of heat from said light emitting diode module to a mounting can adapted to be received and supported within said light fixture housing; and said plurality of leg adapters being dimensioned for engaging said light fixture mounting can in a substantially friction tight fit for supporting the adjustable light emitting diode lighting assembly within said mounting can.

12. The adjustable light emitting diode lighting assembly according to claim 11, wherein said upper locking ring includes a longitudinal cutout to receive an adjustable spacer for engaging in a friction tight fit an interior wall surface area of a mounting can to help facilitate a heat transfer path from said upper locking ring to said mounting can.

13. The adjustable light emitting diode lighting assembly according to claim 8, further comprising:

a plurality of leg adapters spaced around and coupled to said lower base ring for defining a supplemental heat sink member to help facilitate the transfer of heat from said light emitting diode module to said light fixture mounting: and said plurality of leg adapters being dimensioned for engaging said light fixture mounting can in a substantially friction tight fit for supporting the adjustable light emitting diode lighting assembly within said mounting can.

14. The adjustable light emitting diode lighting assembly according to claim 13, wherein said upper locking ring includes a longitudinal cutout dimensioned to receive an adjustable spacer for engaging in a friction tight fit an interior wall surface area of said mounting can to help facilitate a heat transfer path from said upper locking ring to said mounting can.

* * * * *